US008202058B2

(12) United States Patent
Lindholdt et al.

(10) Patent No.: US 8,202,058 B2
(45) Date of Patent: Jun. 19, 2012

(54) VARIABLE DISPLACEMENT PISTON MACHINE WITH A SENSOR

(75) Inventors: Per Nielsen Lindholdt, Soenderborg (DK); Dietmar W. Weiss, Aabenraa (DK)

(73) Assignee: Sauer-Danfoss Inc., Ames, IA (US)

( * ) Notice: Subject to any disclaimer, the term of this patent is extended or adjusted under 35 U.S.C. 154(b) by 373 days.

(21) Appl. No.: 12/503,201

(22) Filed: Jul. 15, 2009

(65) Prior Publication Data

US 2010/0172766 A1 Jul. 8, 2010

(30) Foreign Application Priority Data

Aug. 13, 2008 (DK) ..... 2008 01092

(51) Int. Cl.

| | |
|---|---|
| ***F04B 49/00*** | (2006.01) |
| ***F04B 27/08*** | (2006.01) |
| ***F01B 31/14*** | (2006.01) |
| ***G01R 23/20*** | (2006.01) |

(52) U.S. Cl. ..... 417/63; 417/53; 417/269; 92/13; 324/624

(58) Field of Classification Search ..... 417/53, 417/63, 269; 92/13; 324/624, 644
See application file for complete search history.

(56) References Cited

U.S. PATENT DOCUMENTS

| | | | | |
|---|---|---|---|---|
| 4,112,365 | A | 9/1978 | Larson et al. | |
| 4,533,299 | A * | 8/1985 | Swain et al. | 417/222.2 |
| 4,822,252 | A * | 4/1989 | Ishikawa et al. | 417/222.2 |
| 4,987,823 | A * | 1/1991 | Taplin et al. | 91/361 |
| 5,407,328 | A * | 4/1995 | Kimura et al. | 417/222.1 |
| 6,209,825 | B1 | 4/2001 | Scott | |
| 2006/0266211 | A1 * | 11/2006 | Larkin et al. | 92/5 R |

* cited by examiner

*Primary Examiner* — Charles Freay
(74) *Attorney, Agent, or Firm* — Zarley Law Firm, P.L.C.

(57) ABSTRACT

A variable displacement axial piston machine. The variable displacement axial piston machine includes a cylinder block with at least one main cylinder and main piston, a swash plate, a plunger arrangement with a plunger and auxiliary cylinder, and a sensor. The swash plate is arranged to effect movement of the main piston in the main cylinder upon rotation of the swash plate relative to the cylinder arrangement. The plunger is arranged to tilt the swash plate relative to the cylinder arrangement and to control a stroke of the main cylinder in the main piston. To provide a simple and reliable measurement of displacement of the main piston in the main cylinder, the invention provides a sensor element which is fixed in the auxiliary cylinder and which is adapted to sense movement of the plunger therein.

14 Claims, 2 Drawing Sheets

VARIABLE DISPLACEMENT PISTON MACHINE WITH A SENSOR

The present invention relates to a variable displacement axial piston machine and more particularly, to a variable displacement piston pump or motor with a cylinder block with at least one main cylinder and main piston, a swash plate, a plunger arrangement with a plunger movable in an auxiliary cylinder, and a sensor.

Upon rotation of the swash plate relative to the cylinder arrangement, the swash plate effects movement of the main pistons. The stroke, i.e. the degree of movement of the piston in the cylinder and thus the degree of displacement which is performed by the piston is determined by an angle of inclination of the swash plate relative to the cylinder block.

The plunger is arranged to tilt the swash plate relative to the cylinder arrangement and thereby to change the inclination and thus to control the displacement performed by the main cylinder, and the sensor is arranged to sense the displacement.

BACKGROUND OF THE INVENTION

Conventionally, adjustment of an angle of inclination of a swash plate in a variable displacement piston machine is done via an operating plunger which is in contact with the swash plate so that the movement of the operating plunger causes inclination of the swash plate.

To determine the displacement, various attempts have been made to sense the angle of inclination of the swash plate. In U.S. Pat. No. 6,209,825, an arm of a potentiometer senses the position of a piston rod. The piston is moved by a pressure in two conduits which extend into the housing of the piston pump. The piston which moves the potentiometer is a separate piston which is introduced for sensing purpose only, and the disclosed structure is therefore relatively expensive and requires interaction with the piston pump via the two conduits. This makes the structure of the piston pump more complicated and sensitive to faults in the transmission of the signal between swash plate potentiometer and the separate sensing piston.

A compressor with variable compression rate is disclosed in U.S. Pat. No. 4,822,252. Also in this case, the capacity is varied in accordance with the inclination angle of a wobble plate, and a magnetic sensor is attached to detect this angle. The sensor has a base plate fixed on a sensing housing which is fixed to the cover housing of the compressor via a washer. The sensor senses a position of a slider which is introduced in the housing merely for sensing purposes.

SUMMARY OF THE INVENTION

It is an object of the invention to improve variable displacement axial piston machines by providing a simpler and thus potentially more reliable and cost effective way of sensing displacement of the piston in the servo cylinder of a piston machine. According to a first aspect, the invention provides a variable displacement axial piston machine of the kind mentioned in the introduction in which the sensor comprises a sensor element which is fixed in an auxiliary cylinder in which the plunger operates and which is adapted to sense movement of the plunger itself.

The sensor may be arranged to sense movement of the plunger in the auxiliary cylinder in a very simple and reliable manner, and no additional draw bars, tension rods, or similar linkage elements are necessary between the swash plate and the sensor. The cylinder block and main cylinder with main piston and swash plate can be made in accordance with known piston machines, and the plunger structure may also essentially be similar to that of known piston machines. This also makes the sensor according to the invention suitable for refitting in existing piston machines or as a sensor in piston machines of an existing type by a modest redesign of an isolated part of the machine.

The plunger may e.g. comprise an electrically conductive material, e.g. iron or aluminum, which enables induction of a current, and wherein movement is sensed based on change of impedance by induction in the plunger as it moves in the auxiliary cylinder. The auxiliary cylinder may, for this purpose, include an antenna which transmits a radio frequency (RF) signal which provides induction of a current in the plunger.

The antenna is coupled to an electronic circuit which, based on the change of oscillator frequency, energy loss of the oscillator, phase shift, or combinations of these three effects, determines movement and position of the plunger and which is thus capable of determining the angle of the swash plate and thus the displacement of the main piston in the main cylinder for each stroke of the main piston. Such a sensor could e.g. be of Colpitts type, c.f. e.g. U.S. Pat. No. 4,112,365.

It may be desired to connect the antenna to an electronic circuit which processes frequency shift, energy loss or phase shift of the oscillator. In general, the sensor system may be adapted for at least an almost linear functional dependency between the oscillation frequency and the displacement of the plunger because the change of the impedance of the oscillator coil is approximately linearly dependent on the axial displacement of the surrounding metal parts.

The plunger could be moved in the auxiliary cylinder either electrically, e.g. by a magnetic field, or it could be shaped as a servo piston which is moved by a differential pressure over the plunger in the auxiliary cylinder, or moved between forces from a bias spring on one side of the plunger and a pressure of a fluid medium on the other side of the plunger. In case of the latter, the plunger may be made from any metallic or non-metallic material which can sustain the pressure in question and which is suitable for a structure which can move in close contact with the inner surface of the auxiliary cylinder. In particular by use of the above mentioned sensing principle with induction of a current in the plunger, the plunger should at least include an element of a material in which an electrical current can be induced, or the plunger itself should be made from a material which enables induction of an electrical current therein.

The auxiliary cylinder may be formed by at least one top section in one end of a tubular wall, and optionally by two top sections on opposite sides of the tubular wall. The tubular wall forms an inner surface towards a cylindrical cavity. The antenna could form part of the inner surface, it could be embedded in the wall or even in one of the top sections of the auxiliary cylinder, or it may form an elongated stick which extends from one of the top sections and into the cylindrical cavity. To receive a stick-shaped antenna, the plunger may comprise a bore in which the sensor element is received during movement of the plunger relative to the sensor element. If the plunger is moved electrically in the auxiliary cylinder, e.g. by a magnetic field, the stick-shaped antenna may be shaped and dimensioned relative to the bore so that the plunger is guided in the auxiliary cylinder along the stick-shaped antenna. For this purpose, the stick-shaped antenna may have a smooth outer surface and a dimension by which close contact is provided between the stick-shaped antenna and the plunger.

The piston and swash plate may be included in a main housing, and the sensor element, e.g. the above mentioned antenna, may be fixed to an auxiliary housing which is detachable from the main housing. As an example, the main housing may include the above-mentioned tubular wall portion, and the auxiliary housing may form one of the two top sections from which the antenna extends into the cylindrical cavity, when the auxiliary and main housings are assembled. In addition, the auxiliary housing may hold a bearing for rotational suspension of the main cylinder relative to the swash plate.

In a second aspect, the invention provides the use of a RF sensor for sensing a position of a servo piston in a variable displacement piston machine in which the servo piston is arranged to tilt a swash plate and thus to control the displacement performed by the machine.

In a third aspect, the invention provides a method of determining displacement of the main piston in the main cylinder in a piston machine of the above described kind. The method comprises the steps of:

arranging an antenna in the auxiliary cylinder;

transmitting an electromagnetic wave from the antenna and thereby inducing an electrical current in the plunger;

analyzing the change of electrical parameters of the oscillating circuit based on the principles of a RF sensor employing an oscillator; and determining from the analyzing, a displacement of the main piston in the main cylinder.

DETAILED DESCRIPTION OF THE DRAWINGS

In the following, an embodiment of the invention will be described in further details with reference to the drawing in which.

DETAILED DESCRIPTION OF THE PREFERRED EMBODIMENT

Figure 1:
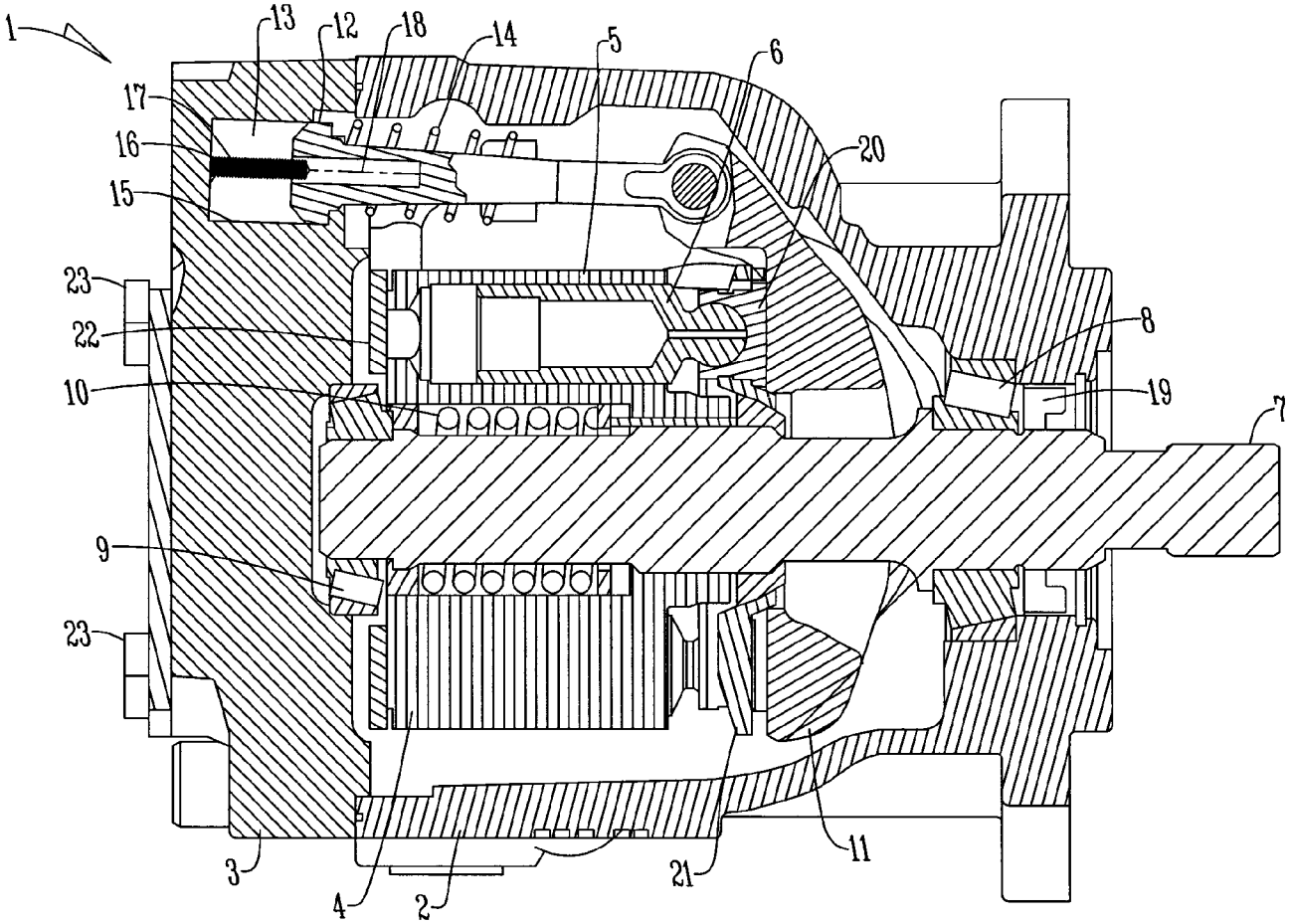
FIG. 1 illustrates a piston machine according to the invention.
Figure 2:
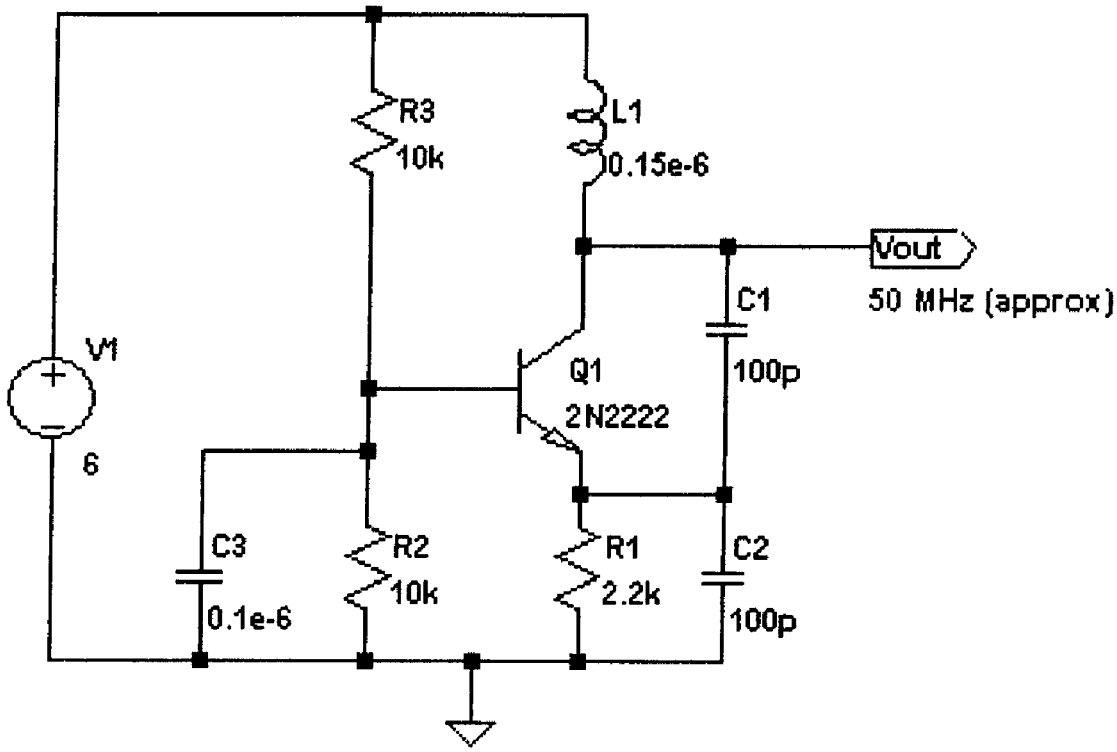
FIG. 2 illustrates, in an electrical diagram, an example of an oscillator.

FIG. 1 illustrates a variable displacement axial piston machine 1 with a main housing 2 and an auxiliary housing 3. The machine comprises a cylinder block 4 with at least one main cylinder 5 and main piston 6. The cylinder block 4 is rotationally suspended via the input shaft 7 which rotates in a first bearing 8 arranged in the main housing 2 and a second bearing 9 arranged in the auxiliary housing 3. A cylinder block spring 10 is arranged to press the cylinder block 4 against the swash plate 11. The swash plate 11 controls the stroke of the main piston 6 in the main cylinder 5 based on a tilting angle of the swash plate 11 relative to the cylinder block 4.

The swash plate 11 is tilted by a plunger arrangement which thereby controls the displacement of the main piston 6 in the main cylinder 5. The plunger arrangement comprises a plunger 12 which is formed as a servo piston being movable in the auxiliary cylinder 13 by a pressure in the auxiliary cylinder 13 acting against the spring force from the bias spring 14. The auxiliary cylinder 13 is formed in the auxiliary housing 3 and comprises a tubular wall 15 and a top section 16.

To determine the position of the plunger 12 in the auxiliary cylinder 13, and thus to determine displacement of the main piston 6 in the main cylinder 5, the machine comprises a sensor with a stick-shaped antenna 17. The antenna 17 is fixed in the top section 16 and extends into the auxiliary cylinder 13. During movement of the plunger 12 in the auxiliary cylinder 13, the antenna 17 is received in a bore 18 provided axially in the plunger 12.

The antenna is part of an oscillating circuit by which frequency or output voltage can be analyzed.

The machine in FIG. 1 further comprises a shaft seal 19, a slipper 20, a slipper retainer 21, and a valve plate 22. The auxiliary housing 3 is fixed to the main housing 2 by bolts 23 allowing disassembly for easy maintenance and access e.g. to the antenna 17.

The invention claimed is:

1. A variable displacement axial piston machine (1) comprising:

a cylinder block (4), at least one main cylinder (5), at least one main piston (6), a swash plate (11), at least one plunger (12), at least one auxiliary cylinder (13), and a sensor, where the main piston (6) is movable in the main cylinder (5) upon relative movement between the swash plate (11) and the main cylinder (5), where a stroke of the main piston (6) depends on a degree of tilting of the swash plate (11) relative to the main cylinder (5), and where the plunger (12) can tilt the swash plate (11) relative to the main cylinder (5) and thereby control the stroke of the main piston (6) in the main cylinder (5), wherein the sensor comprises an antenna (17) which is fixed in the auxiliary cylinder (13) and is received within a bore (18) provided in the plunger (12) such that the antenna (17) senses movement of the plunger (12) based on change of impedance by induction in the plunger (12) and determines an angle of the swash plate (11) based upon a functional dependency between the plunger (12) and the antenna (17) disposed linearly therein.

2. A machine according to claim 1, wherein the plunger (12) is a servo piston.

3. A machine according to claim 1, wherein the main piston (6) and swash plate (11) are included in a main housing (2), and the sensor element (17) is fixed to an auxiliary housing (3) which is detachable from the main housing (2).

4. A machine according to claim 3, wherein the auxiliary housing (3) forms at least a portion of the auxiliary cylinder (13).

5. A machine according to claim 3, wherein the auxiliary housing (3) holds a bearing (9) for rotational suspension of the main cylinder (5) relative to the swash plate (11).

6. A machine according to claim 1, wherein the plunger (12) is made from an electrically conductive material.

7. A method of determining displacement of at least one main piston in at least one main cylinder of a piston machine in which tilting of a swash plate controls the displacement, and in which the swash plate is tilted by a plunger operating in an auxiliary cylinder, said method comprising the steps of:

arranging an antenna in the auxiliary cylinder received within a bore provided in the plunger;

transmitting an electromagnetic wave from the antenna and thereby inducing an electrical current in the plunger;

analyzing the change of electrical parameters of the oscillating circuit based on the principles of a RF sensor employing an oscillator;

determining from the analyzing, a displacement of the at least one main piston in the at least one main cylinder; and wherein the antenna senses movement of the plunger based on change of impedance by induction in the plunger and determines an angle of the swash plate based upon a functional dependency between the plunger and the antenna disposed linearly therein.

8. A variable displacement axial piston machine (1) comprising:

a cylinder block (4), at least one main cylinder (5), at least one main piston (6), a swash plate (11), at least one plunger (12) arranged in a main housing (2);

at least one auxiliary cylinder (13) fixed to the main housing (2) having a tubular wall (15) and a top section (16) formed in an auxiliary housing (3) and a sensor;

wherein the main piston (6) is movable in the main cylinder (5) upon relative movement between the swash plate (11) and the main cylinder (5);

wherein a stroke of the main piston (6) depends on a degree of tilting of the swash plate (11) relative to the main cylinder (5);

wherein the plunger (12) can tilt the swash plate (11) relative to the main cylinder (5) and thereby control the stroke of the main piston (6) in the main cylinder (5), wherein the sensor comprises an antenna (17) which extends linearly from the top section (16) of the auxiliary cylinder (13) and is received within a bore (18) provided in the plunger (12) such that the antenna (17) senses movement of the plunger (12) and determines an angle of the swash plate (11) based upon a linear functional dependency between the plunger (12) and the antenna (17).

9. A machine according to claim 8, wherein the plunger (12) comprises a material which enables induction of a current, and wherein movement is sensed based on change of impedance by induction in the plunger (12).

10. A machine according to claim 8, wherein the plunger (12) is a servo piston.

11. A machine according to claim 8, wherein the auxiliary housing (3) is detachable from the main housing (2).

12. A machine according to claim 11, wherein the auxiliary housing (3) forms at least a portion of the auxiliary cylinder (13).

13. A machine according to claim 8, wherein the auxiliary housing (3) holds a bearing (9) for rotational suspension of the main cylinder (5) relative to the swash plate (11).

14. A machine according to claim 8, wherein the plunger (12) is made from an electrically conductive material.

* * * * *